United States Patent [19]

Kamiya

[11] 4,203,279

[45] May 20, 1980

[54] TIMEPIECE WHICH PERMITS FREELY ADJUSTING THE LEVEL OF SOUNDS PRODUCED THEREIN AND GIVEN OUT THEREOF

[76] Inventor: Minoru Kamiya, 46-3, 2-chome, Minami Otsuka, Toshima-ku, Tokyo, Japan

[21] Appl. No.: 886,932

[22] Filed: Mar. 15, 1978

[30] Foreign Application Priority Data

Oct. 31, 1977 [JP] Japan ..... 52/130646

[51] Int. Cl.[2] ..... G04B 37/00; G04B 23/10

[52] U.S. Cl. ..... 368/243; 368/245; 368/315

[58] Field of Search ..... 58/2, 12–14, 58/16, 21.12, 38 R, 38 A, 53–56, 88 R, 88 G, 90 R, 57.5, 152 B; 181/33 K, 36 R

[56] References Cited

U.S. PATENT DOCUMENTS

| | | | |
|---|---|---|---|
| 1,782,378 | 11/1930 | Bahr | 58/14 |
| 1,907,282 | 5/1933 | Waldheim | 58/21.12 |
| 1,907,283 | 5/1933 | Waldheim | 58/21.12 |
| 2,506,379 | 5/1950 | Muchow | 58/21.12 |
| 2,856,751 | 10/1958 | Preiser | 58/21.12 |
| 3,251,182 | 5/1966 | Marble | 58/21.12 |
| 3,559,396 | 2/1971 | Wingler | 58/21.12 |

FOREIGN PATENT DOCUMENTS

| | | | |
|---|---|---|---|
| 942977 | 5/1956 | Fed. Rep. of Germany | 58/21.12 |

*Primary Examiner*—Vit W. Miska
*Attorney, Agent, or Firm*—Brisebois & Kruger

[57] ABSTRACT

A timepiece which permits freely adjusting the level of sounds produced therein and given out thereof. In this timepiece, the sounds produced in a mechanical unit contained in a timepiece body are conveyed to the outside of the timepiece via a sound level adjusting means by utilizing mechanical vibrations or vibrations of air.

9 Claims, 8 Drawing Figures

TIMEPIECE WHICH PERMITS FREELY ADJUSTING THE LEVEL OF SOUNDS PRODUCED THEREIN AND GIVEN OUT THEREOF

BACKGROUND OF THE INVENTION

1. Field of the Invention

The present invention relates to a timepiece which permits freely adjusting the level of sounds produced by a mechanical unit therein and, more particularly, to a timepiece which permits freely enlarging or reducing the sounds produced thereby to a desired level.

2. Brief Description of the Prior Art

A sundial utilizing the movements of the sun and moon started the history of the relation between mankind and timepieces and, since then, various kinds of timepieces have been invented, such as a sandglass, spring type timepiece utilizing the oscillations of pendulum or balance-wheel, and electric timepiece operated by an electric current which are currently used. Timepieces utilizing a pendulum or balance-wheel, or timepieces utilizing a tuning fork or quartz oscillator which are currently available produce without exceptions a certain kind of sounds, and there are no timepieces that do not product any sound at all.

Mankind has long communed in its everyday life with the sounds produced by timepieces and the latter cannot be separated from the life of the former. The sounds produced by timepieces include ones occurring in a balance-wheel type timepiece when toothed wheels are driven as an escape wheel of the escapement is engaged with an anchor, and ones produced by a ticking mechanism and alarm mechanism of various types of timepieces. There are some timepieces having a mechanical unit provided with various kinds of elastic packings therein to reduce the propagation of sounds produced thereby or prevent sounds from occurring. Such timepieces, however, may break the rhythm of life of the user or give the user dissatisfaction, though this may depend upon the personality of the user and the place in which such timepieces are installed. The sounds from an alarm clock, for example, are preferably low in most cases during sleeping hours. However, there are some in fact who do not fall asleep unless they hear a moderate level of ticking sounds from a timepiece.

SUMMARY OF THE INVENTION

An object of the present invention is to provide a timepiece which permits freely adjusting the level of sounds produced thereby.

Another object of the present invention is to provide a timepiece which permits freely adjusting the sounds produced thereby to a desired level in accordance with the user's choice and in the light of the place of installation thereof or using conditions therefor.

Still another object of the present invention is to provide a timepiece having a sound level adjusting means for adjusting the level of sounds produced by the internal mechanism thereof to convey by a mechanical means or vibration of air a desired level of sounds to the outside of the timepiece body.

A further object of the present invention is to provide a timepiece having a sound level adjusting means for conveying a desired level of sounds to the outside of the timepiece body while utilizing the sound propagation effects of mechanical and aerial vibrations.

Other objects of the present invention will become apparent from the following description and the accompanying drawings.

DESCRIPTION OF THE PREFERRED EMBODIMENT

Now, the embodiments of the present invention will be described with reference to the accompanying drawings.

Figure 1:
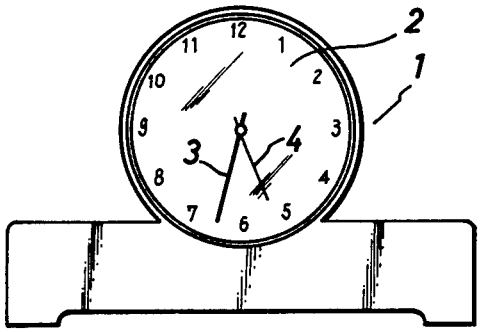
FIG. 1 is a front elevational view of the timepiece of the present invention.
Figure 2A:
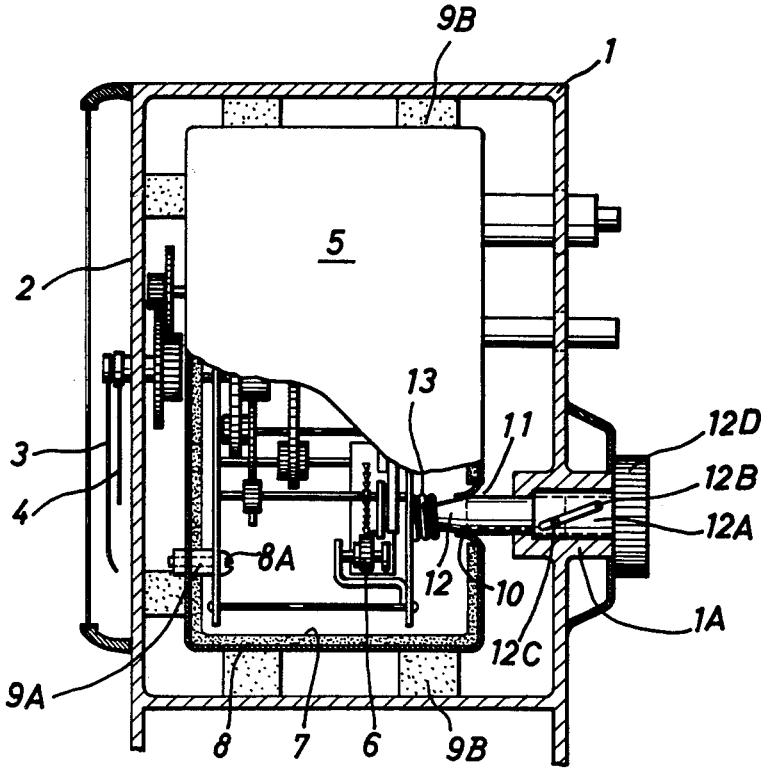
FIG. 2A is an enlarged cross-sectional view of an important portion of a first embodiment of the present invention.

The sounds from sound producing parts of a timepiece are roughly classified into two, i.e. sound conveyed to the outside through a mechanical unit therein and sounds directly conveyed to the outside by the vibrations of air therein. A timepiece body 1 as shown in FIG. 1, contains therein a mechanical unit 5 as shown in FIG. 2A. The mechanical unit 5 includes a power supplying means, such as a flat spiral spring for driving a minute hand 3 and an hour hand 4 along a dial-plate 2, toothed wheels and an escapement. In a balance-wheel type timepiece, in which a minute hand 3 and hour hand 4 are driven while letting the teeth of the final escape wheel in power transmitting toothed wheels escape one by one via an anchor actuated by the movements of a pendulum or balance-wheel, sounds are produced mainly when the teeth of the escape wheel are driven. In the present invention, the whole of the mechanical unit 5, by which the sounds are produced, is housed in an inner case 8 lined with a sound-proofing material 7, or made by sound-proofing material. The inner case 8 is secured to the timepiece body 1 with a bolt 8A via a buffer member 9A while inserting buffer materials 9B serving as sound-proofing members between the inner case 8 and timepiece body 1, so as to isolate the sounds. The inner case 8 has an opening portion at one end and this opening portion may be put on and fixed to the plate behind the dial-plate 2 of the timepiece body 1. Whereby it can be easily applied to the existing timepieces. In this case, the plate behind the dial-plate 2 serves also as part of the inner case and is sound-proof and is connected to the back plate. Thus, the inner case 8 is held in a predetermined position within the timepiece body 1 to mechanically connect the mechanical unit 5 contained in the inner case 8 to the timepiece body 1 so that the sounds produced by the mechanical unit 5 is conveyed to the outside of the timepiece body 1 by the vibrations of the air therein.

Figure 3A:
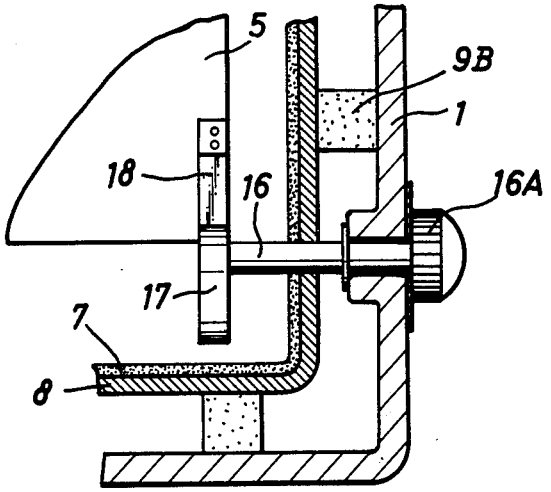
FIG. 3A is an enlarged cross-sectional view of an important portion of a second embodiment of the present invention.

In the embodiments as shown in FIGS. 2A and 3A, the sounds produced therein are mechanically conveyed to the outside. Referring to FIG. 2A, an opening 11 which is opened and closed by an elastic cover 10 is provided in a part of the inner case 8, and a sound conveying rod 12 supported by the corresponding part of the timepiece body 1 is moved into and out of the opening 11. When the sound conveying rod 12 is forced into the opening 11 to open the elastic cover 10 and urged against the mechanical unit 5 whereby sounds are produced, the sounds are conveyed to the outside via the rod 12 and timepiece body 1. It is preferable that the whole or a part of the timepiece body 1 is so made that it is resonant with the sounds from the mechanical unit 5. The mechanical unit 5 is provided with a coil spring 13 or a leaf spring, against which the rod 12 is urged to adjust the level of sounds to be conveyed to the outside in accordance with the magnitude of the urging force.

Figure 2B:
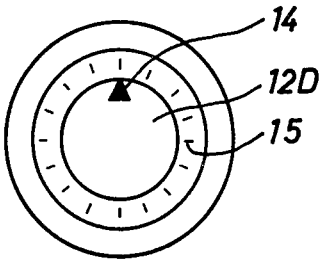
FIG. 2B is a front elevational view of a knob of the embodiment as shown in FIG. 2A.

The sound conveying rod 12 is inserted in and supported by a sleeve 12A which is rotatably supported by a bearing portion 1A of the timepiece body 1. In a diagonally elongated slot 12B made in the sleeve 12A, a pin 12A of the sound conveying rod 12 is fitted. The sound conveying rod 12 is prevented from being rotated by a key (not shown) provided on the bearing portion 1A, and it is moved to and fro by turning a knob 12D provided at the outer end of the sleeve 12A. On the outer surface of the knob 12D, an arrow 14 is drawn as shown in FIG. 2B so that the level of sounds can be read on a scale 15 provided on the timepiece body 1. Thus, the level of sounds produced in the timepiece can be adjusted while moving to and fro the sound conveying rod 12 and are indicated on the scale 15.

Figure 3B:
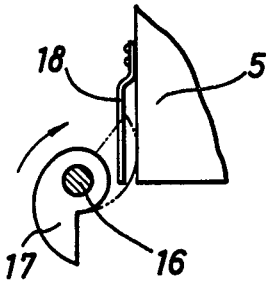
FIG. 3B is a front elevational view of a sound level adjusting means in the embodiment as shown in FIG. 3A.

In the embodiment as shown in FIG. 3A, the level of sounds produced inside the timepiece are also adjusted by turning a sound conveying rod. The embodiment will be described below while referring with the same numerals to such parts thereof that are the same as those of the embodiment as shown in FIG. 2A with descriptions of such parts omitted. Referring to FIG. 3A, a sound conveying rod 16 is rotatably supported by a timepiece body 1. The sound conveying rod 16 is passed through an inner case 8 and provided at the inner end thereof with a cam type contact member 17 of a varied diameter so that the contact member 17 is at right angles to the rod 16. When a knob 16A for the sound conveying rod 16 is turned to rotate the latter at a certain angle as shown in FIG. 3B, the contact member 17 acts on a leaf spring 18 provided on a mechanical unit 5 to convey the sounds produced therein to the timepiece body 1 via the rod 16. The resulting sounds are conveyed to the outside by the resonating effect thereof. Namely, when the sound conveying rod 16 is rotated to adjust the pressure thereby exerted on the leaf spring 18, the sounds produced in the timepiece are enlarged or reduced and conveyed to the outside thereof.

Figure 4A:
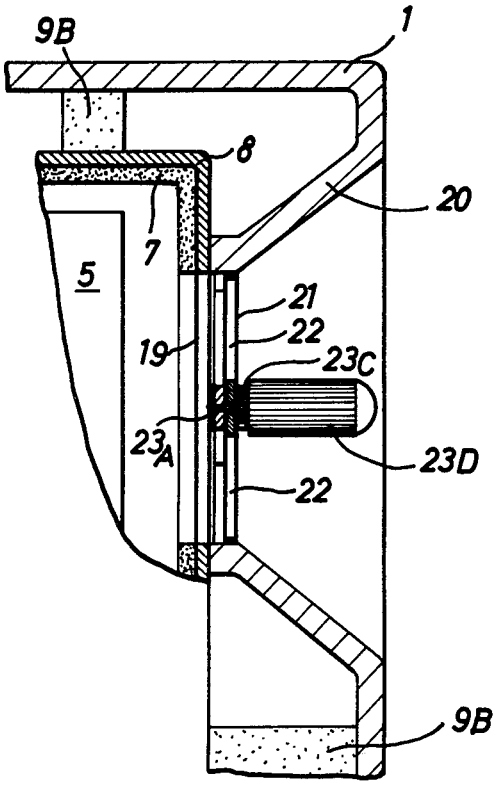
FIG. 4A is an enlarged cross-sectional view of an important portion of a third embodiment of the present invention.
Figure 4B:
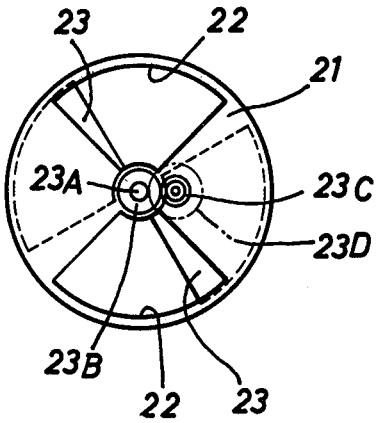
FIG. 4B is a front elevational view of a sound level adjusting means in the embodiment as shown in FIG. 4A.

FIG. 4A shows another embodiment of the present invention in which the sounds produced in the timepiece are conveyed to the outside thereof by the vibrations of the air therein. In this embodiment, an inner case 8 containing a mechanical unit 5 is provided in a portion thereof with a circular opening 19 of a predetermined diameter. At such a portion of the timepiece body 1 that is opposed to the opening 19, a conical megaphone 20 is provided. In the opening 19, a disc 21 is fitted, which has a pair of fan-shaped openings 22 as well as a shutter 23 pivotally connected to a shaft 23A passed through the central portion thereof. On the shaft 23A of the shutter 23, a toothed wheel 23B is mounted, with which a driver 23C integrally formed with a knob 23D is engaged. When the knob 23D is turned, the shutter 23 is rotated so that the area of the openings 22 can be adjusted. The sounds produced in the mechanical unit 5 are conveyed by the vibrations of air through the openings 22 and megaphone 20, where the sounds are enlarged, to the outside of the timepiece. The level of the sounds conveyed to the outside of the timepiece is adjusted by regulating the area of the fan-shaped openings 22.

Figure 5:
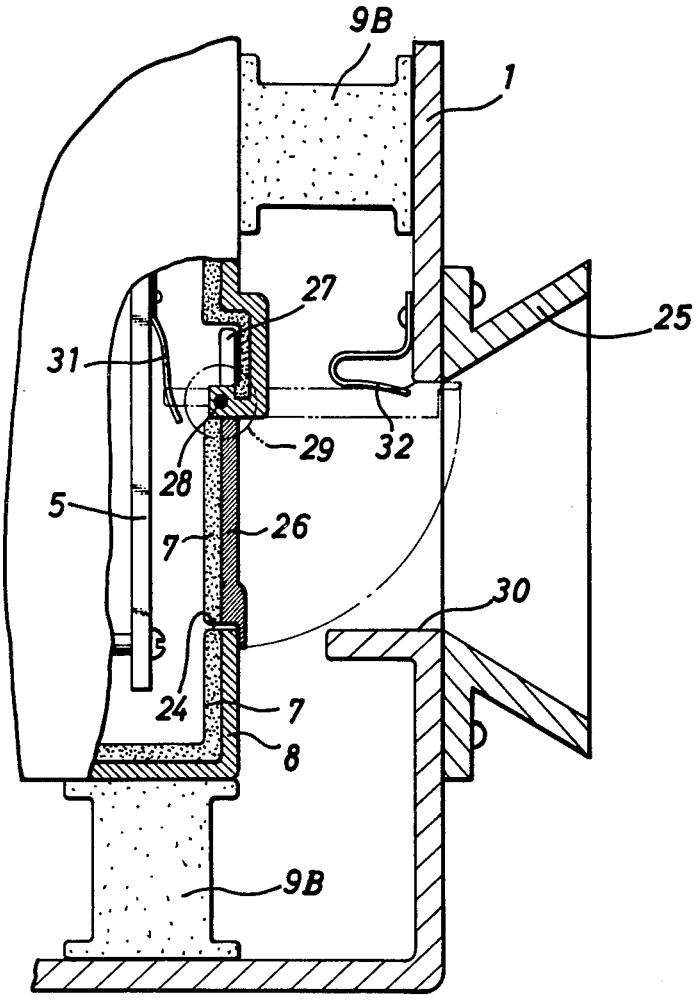
FIG. 5 is an enlarged cross-sectional view of a fourth embodiment of the present invention.

FIG. 5 shows still another embodiment of the present invention in which the sounds produced in the timepiece are conveyed to the outside thereof by a combination of a mechanical means and the vibrations of air. In this embodiment, an inner case 8 is provided at a portion thereof with an opening 24, and, at such a portion of a timepiece body 1 that is opposed to the opening 24, an opening 30 is provided. To such a portion of the outer surface of the timepiece body 1 that surrounds the opening 30, a megaphone 25 is secured. A rotary cover 26 whereby the opening 24 is opened and closed is pivotally supported on an operation rod 28 which is supported on a portion of the inner case 8. The rotary cover 26 is provided with a contact member 27 integrally formed therewith which is extended into the inner case 8. To the outer surface, toward which the contact member 27 is moved, of the mechanical unit 5, a leaf spring 31 is secured. To such a portion of the timepiece body 1 that is opposed to the end of the rotary cover 26 fully opened, a leaf spring 32 is secured. The operation rod 28 is provided with a handle 29 outside the timepiece body 1. When the handle 29 is turned, the rotary cover 26 is rotated to open the opening 24 and then, the sounds produced in the mechanical unit 5 are conveyed by the vibrations of air through the opening 24 to the outside of the inner case 8. The sounds are then enlarged in the megaphone 25 and conveyed outside the timepiece body 1. When the degree of opening of the rotary cover 26 is the largest, the edge thereof acts on the leaf spring 32 secured to the inner surface of such a portion of the timepiece body 1 that is near the opening 30, while the contact member 27 provided at the inner end of the rotary cover 26 acts on the leaf spring 31 provided on the mechanical unit 5. At this time, the sounds produced in the mechanical unit 5 is conveyed via the contact member 27 and rotary cover 26 to the resonant timepiece body 1. Thus, the mechanical conveyance of the sounds produced in the mechanical unit 5 is carried out. The rotary cover 26 is lined with a sound-proofing material 7 to prevent the leak of sounds while it is closed. The above are the descriptions of various types of embodiments of the present invention. The sound level adjusting means used in the present invention is not limited to the ones shown in these embodiments or, needless to say, it may be of any type if it permits conveying mechanically or by the vibrations of air the sounds produced in a timepiece to the outside and adjusting the level of the sounds to be conveyed to the outside.

Since the present invention permits as described above isolating the sounds produced in the mechanical unit 5 in the timepiece body, and conveying the sounds to the outside of the timepiece body via a sound level adjusting means whereby the sounds produced in the mechanical unit 5 are conveyed mechanically or by the vibrations of air to the outside thereof, the sounds conveyed to the outside of the timepiece can be freely adjusted to an optional level by enlarging or reducing it in accordance with the user's desire or in the light of the place of installation thereof and conditions for the use thereof. In other word, the present invention provides an ideal timepiece which gives out a desired level of sounds.

In general timepieces, the level of sound is constant. To the contrary, in the present invention, it is possible to enlarge the sound level more than that of the conventional timepiece from silent state by utilization of resonance phenomenon or magnifying mechanism of the timepiece body.

The construction of the present invention can be freely applied to any type of timepiece, such as a spring type timepiece utilizing the oscillations of pendulum or balance-wheel, a timepiece operated by weights, an electric timepiece, a timepiece utilizing a tuning fork or a quartz oscillator, a wrist watch, a table-clock, a wall-clock.

What is claimed is:

1. In a timepiece equipped with a mechanical unit including sound producing means for producing a time-ticking sound, such as an escapement having isochronism, the improvement comprising, an outer casing;

a sound proof inner casing within said outer casing, said inner casing containing said mechanical unit; buffer means supporting said inner casing in spaced relation to said outer casing, said buffer means accoustically isolating said inner casing from said outer casing;

sound level adjusting means for conveying sound produced by the mechanical unit from said inner casing, said sound level adjusting means including means for freely adjusting the level of the sound conveyed from said inner casing in a range from a condition of essentially silence to a predetermined level; and means for enlarging the sound conveyed from the inner casing.

2. A timepiece according to claim 1 wherein, said sound level adjusting means comprises means for manually adjusting the level of conveyed sound at any time.

3. A timepiece according to claim 1 wherein said second level adjusting means comprises conduction means engageably with said mechanical unit for mechanically conducting vibrations from said inner casing to said outer casing, and means for manually controlling the pressure of engagement of the conduction means with the mechanical unit to control the level of the sound conducted to the outer casing.

4. A timepiece according to claim 3 wherein said conduction means comprises an axially moveable sound conducting element, and means mounting said element for axially movement to vary the pressure thereof against said mechanism in response to rotation of said element.

5. A timepiece according to claim 3 wherein said conduction means comprises a rotatable element, a cam on said element and within said inner casing; a spring on said mechanical unit, and means outside said outer casing for rotating said element to change the pressure of the cam on said spring.

6. A timepiece according to claim 3 wherein said means for enlarging the sound comprises an outer casing resonant at the frequency of the sound conducted from the inner casing.

7. A timepiece according to claim 1 wherein said sound conveying means comprises an opening in said inner casing between said mechanical unit and said outer casing, and closure means for said opening, and said level adjusting means comprises means on the outside of the outer casing for moving said closure between an open and a closed position.

8. A timepiece according to claim 7 further comprising means on said outer casing for engaging said closure to further transmit sound by conduction through said closure between said inner casing and said outer casing.

9. A timepiece according to claim 1 wherein said means for enlarging the sound comprises a megaphone on said outer casing.

* * * * *